US005647571A

United States Patent [19]

Hupp

[11] Patent Number: 5,647,571

[45] Date of Patent: Jul. 15, 1997

[54] MOLD DEVICE FOR FORMING CONCRETE BORDER STONES

[76] Inventor: Jack T. Hupp, P.O. Box 1206, Richmond, Tex. 77469

[21] Appl. No.: 580,642

[22] Filed: Dec. 29, 1995

[51] Int. Cl.[6] ..... B28B 7/24

[52] U.S. Cl. ..... 249/2; 249/117; 249/129; 249/130; 249/188; 404/38

[58] Field of Search ..... 249/9, 42, 2, 189, 249/205, 74, 75, 76, 52, 117; 404/37, 38, 42

[56] References Cited

U.S. PATENT DOCUMENTS

| | | | |
|---|---|---|---|
| Re. 24,085 | 11/1955 | Nigro | 249/52 |
| 996,174 | 6/1911 | Wege | 249/76 |
| 1,360,214 | 1/1920 | Henderson | 249/74 |
| 2,266,844 | 4/1941 | Bouchard | 249/74 |
| 2,584,776 | 2/1952 | Woznuk | 249/74 |
| 4,014,451 | 3/1977 | Cannon et al. | 249/130 |
| 4,287,141 | 9/1981 | Russell | 264/33 |
| 4,921,204 | 5/1990 | Melfi | 249/2 |
| 5,487,526 | 1/1996 | Hupp | 249/2 |

*Primary Examiner*—Jay H. Woo
*Assistant Examiner*—Iurie A. Schwartz
*Attorney, Agent, or Firm*—Kenneth A. Roddy

[57] ABSTRACT

A mold apparatus for forming concrete border stones has a unitary generally rectangular body with contiguous opposed longitudinal side walls, opposed outwardly curved end walls at each end thereof, an open bottom end, an apertured top wall, and an interior vertical wall extending transversely between the longitudinal side walls. The walls circumscribe generally rectangular longitudinally adjacent cavities for receiving concrete therein and generally rectangular openings in the top wall define generally rectangular longitudinally adjacent openings at an upper end of the cavities. An opening through a lower portion of the interior vertical wall joins the lower portion of adjacent ends of the cavities together. In a preferred embodiment the vertical wall is disposed closer to one end wall than the other to form a longer generally rectangular stone shape and a longitudinally adjacent shorter generally rectangular stone shape. A plurality of reinforcing ribs on the exterior of the mold prevent distortion and a plurality horizontally protruding tabs on the exterior facilitate manual manipulation of the mold. After removal of the mold there is a small gap between the adjacent stones except at their lower portions which are joined together by a short web of concrete filling the gap. The stones may be used in the adjacently joined condition or may be separated by removing the web of concrete, and may be positioned relative to one another to form various linear, curved, and circular stone border arrangements.

4 Claims, 3 Drawing Sheets

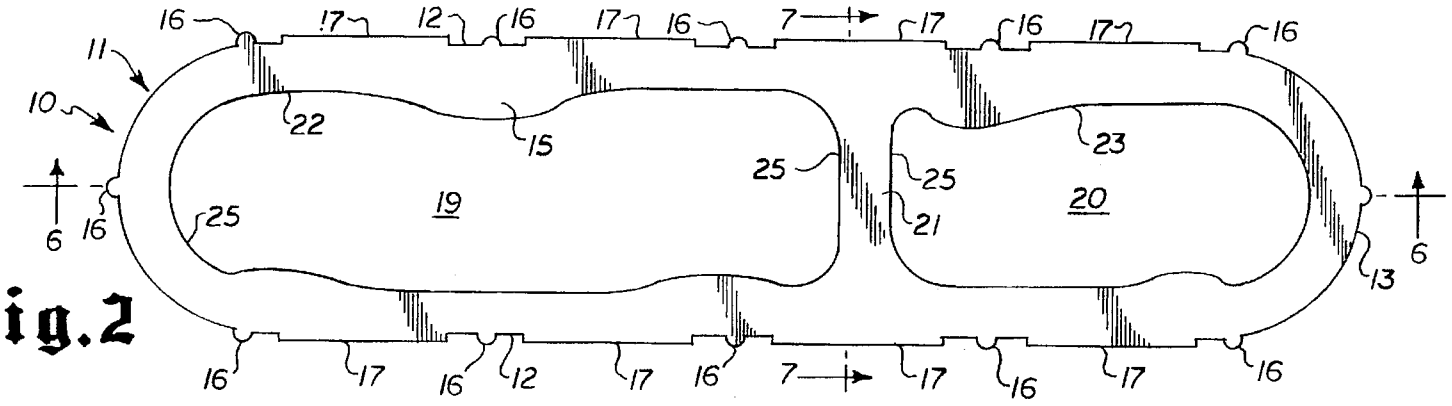
fig. 2
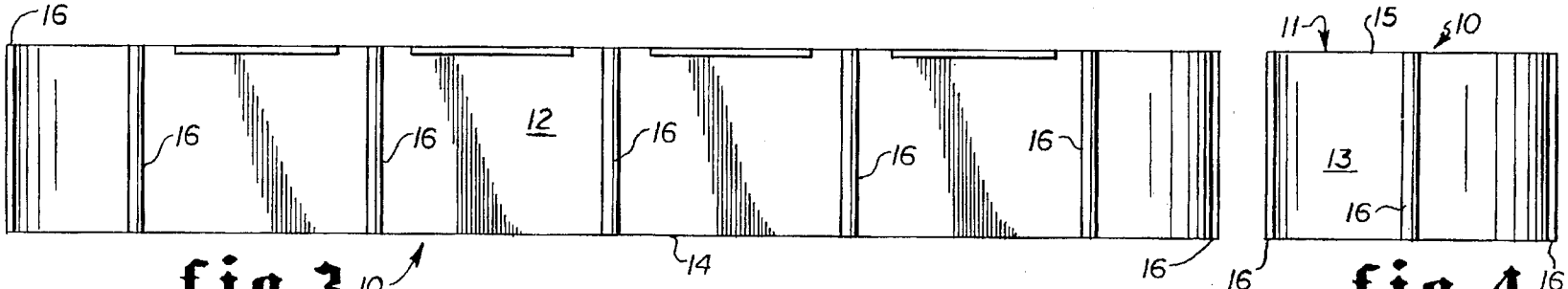
fig. 3
fig. 4
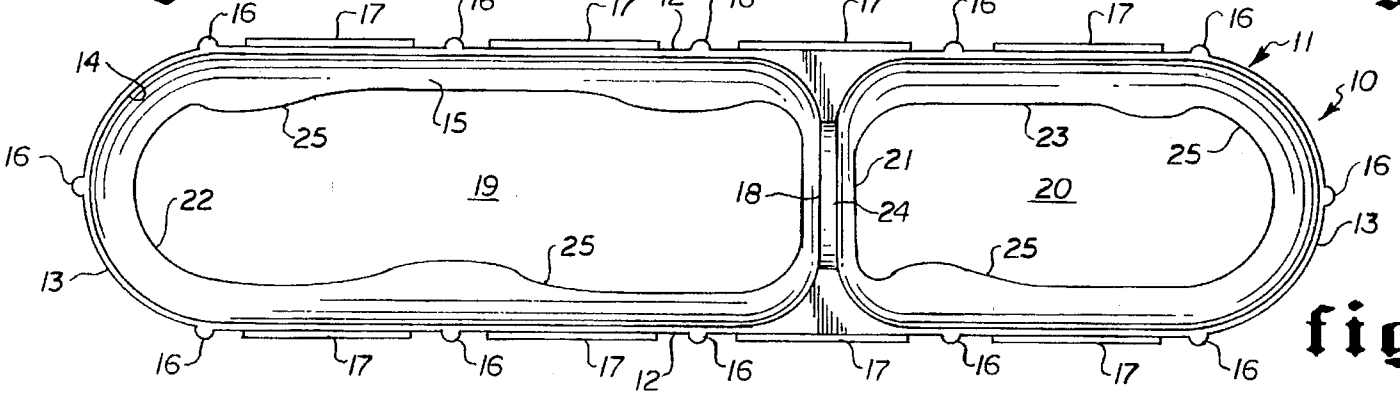
fig. 5

MOLD DEVICE FOR FORMING CONCRETE BORDER STONES

BACKGROUND OF THE INVENTION

1. Field of the Invention

This invention relates generally to molds for concrete products, and more particularly to a unitary plastic mold having generally rectangular longitudinally adjacent cavities fox forming concrete border stones which may be used in an adjacently joined or separated configuration and positioned relative to one another to form various linear, curved, and circular stone border arrangements.

BRIEF DESCRIPTION OF THE PRIOR ART

The formation of sidewalks or concrete pathways typically requires excavation of a pathway, the assembly of wooden or metal forms which normally are required to restrain the sides of the concrete after pouring and then disassembly of the wooden or metal forms once the concrete has cured. Thus, concrete forming methods are costly both in terms of labor and materials.

Concrete forming devices known in the art employ a mold to form the concrete to a desired shape. As the concrete begins to cure, the mold is removed and the next concrete member or section is formed. The use of such mold devices allows concrete sections of relatively uniform shape to be continuously formed having the cross-sectional configuration of the mold. Such mold devices include U.S. Pat. No. 2,893,098 to Tilley which discloses a mold for applying simulated masonry to walls and to the exterior surfaces of buildings. U.S. Pat. No. 3,600,773 to Davis discloses a concrete forming device of rather complex construction. A mold component of the device includes movable lower side edge portions which are resiliently biased downwardly to accommodate surface irregularities for confining the concrete in the mold.

U.S. Pat. No. 4,287,141 to Russell discloses an apparatus for forming embankments of trapezoidal shape. The trapezoidal-shaped shield apparatus is opened at the top and bottom, and rearwardly. Concrete is introduced into the top of the shield for forming each segment of the embankment.

U.S. Pat. No. 4,354,773 to Noack discloses a simulated interlocking stone paving block which are formed with a mold. U.S. Pat. No. 4,407,480 to Trimmer et al discloses a textured brick form. U.S. Pat. No. 4,609,303 to Schumaker discloses an apparatus for forming concrete pathways which moves along the path as concrete is poured through a hopper extending upwardly from the apparatus.

The present invention is distinguished over the prior art in general, and these patents in particular by a mold apparatus for forming concrete border stones which has a unitary generally rectangular body with contiguous opposed longitudinal side walls, opposed outwardly curved end walls at each end thereof, an open bottom end, an apertured top wall, and an interior vertical wall extending transversely between the longitudinal side walls. The walls circumscribe generally rectangular longitudinally adjacent cavities for receiving concrete therein and generally rectangular openings in the top wall define generally rectangular longitudinally adjacent openings at an upper end of the cavities. An opening through a lower portion of the interior vertical wall joins the lower portion of adjacent ends of the cavities together. In a preferred embodiment the vertical wall is disposed closer to one end wall than the other to form a longer generally rectangular stone shape and a longitudinally adjacent shorter generally rectangular stone shape. A plurality of reinforcing ribs on the exterior of the mold prevent distortion and a plurality horizontally protruding tabs on the exterior facilitate manual manipulation of the mold. After removal of the mold there is a small gap between the adjacent stones except at their lower portions which are joined together by a short web of concrete filling the gap. The stones may be used in the adjacently joined condition or may be separated by removing the web of concrete, and may be positioned relative to one another to form various linear, curved, and circular stone border arrangements.

SUMMARY OF THE INVENTION

It is therefore an object of the present invention to provide a lightweight manually manipulated mold for quickly and easily forming concrete border stones which may be positioned relative to one another to form various linear, curved, and circular stone border arrangements.

It is another object of this invention to provide a mold for forming adjacent concrete border stones in one operation.

Another object of this invention is to provide a mold for forming adjacent concrete border stones connected by a web of concrete which may be easily and quickly removed to separate the stones such that the stones can be used in the adjacently joined or separated configuration and positioned relative to one another to form various linear, curved, and circular stone border arrangements.

Another object of this invention is to provide a mold for forming adjacent concrete border stones which are generally rectangular in shape and have a natural stone-like upper portion.

A further object of this invention is to provide a mold for simultaneously forming a longer generally rectangular stone configuration and an adjacent shorter generally rectangular stone configuration in one operation.

A still further object of this invention is to provide a mold for forming concrete border stones which is simple in construction, economical to manufacture and long lasting and durable in use.

Other objects of the invention will become apparent from time to time throughout the specification and claims as hereinafter related.

The above noted objects and other objects of the invention are accomplished by a mold apparatus for forming concrete border stones which has a unitary generally rectangular body with contiguous opposed longitudinal side walls, opposed outwardly curved end walls at each end thereof, an open bottom end, an apertured top wall, and an interior vertical wall extending transversely between the longitudinal side walls. The walls circumscribe generally rectangular longitudinally adjacent cavities for receiving concrete therein and generally rectangular openings in the top wall define generally rectangular longitudinally adjacent openings at an upper end of the cavities. An opening through a lower portion of the interior vertical wall joins the lower portion of adjacent ends of the cavities together. In a preferred embodiment the vertical wall is disposed closer to one end wall than the other to form a longer generally rectangular stone shape and a longitudinally adjacent shorter generally rectangular stone shape. A plurality of reinforcing ribs on the exterior of the mold prevent distortion and a plurality horizontally protruding tabs on the exterior facilitate manual manipulation of the mold. After removal of the mold there is a small gap between the adjacent stones except at their lower portions which are joined together by a short web of concrete filling the gap. The stones may be used in the adjacently joined condition or may be separated by removing the web of concrete, and may be positioned relative to one another to form various linear, curved, and circular stone border arrangements.

BRIEF DESCRIPTION OF THE DRAWINGS

FIG. 2 is a top plan view of the mold device.

FIG. 3 is a side elevation of mold device.

FIG. 4 is an end elevation of the mold device.

FIG. 5 is a bottom plan view of the mold device.

DESCRIPTION OF THE PREFERRED EMBODIMENT

Figure 1:
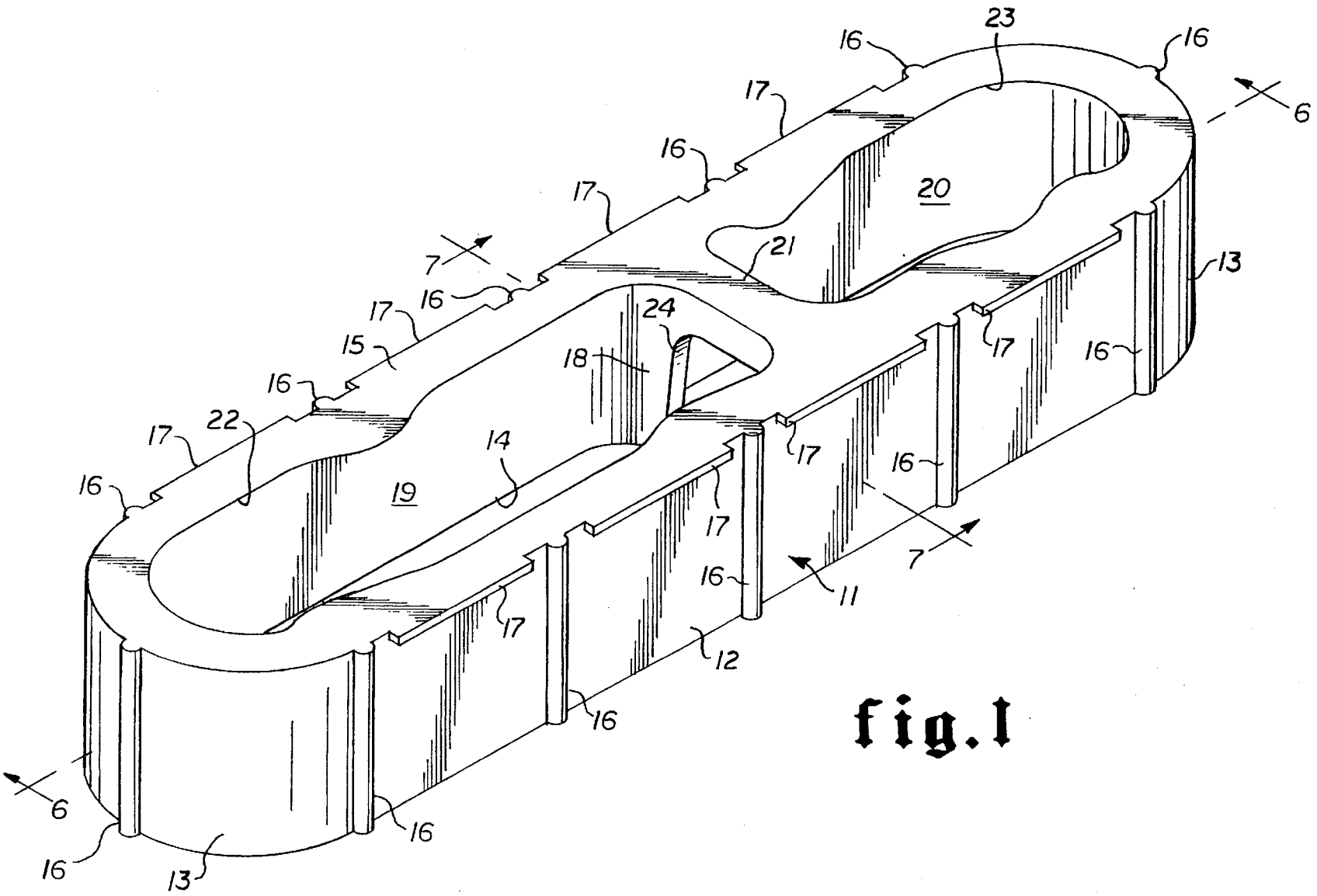
FIG. 1 is a perspective view of the mold device in accordance with the present invention.

Referring to the drawings by numerals of reference, there is shown in FIGS. 1–5, a preferred mold device 10 in accordance with the present invention for forming concrete border stone configurations. The mold 10 has a generally rectangular unitary plastic body 11 having opposed elongate longitudinal side walls 12, contiguous opposed curved end walls 13, an open bottom 14, and an apertured, generally open, top wall 15. In a preferred embodiment, the outside dimensions of the mold 10 are approximately 18 inches in length, 4 inches in width, and a height of 2¾ inches.

A plurality of vertical reinforcing ribs 16 are molded into the exterior surface of the mold body 11 and are spaced a distance apart along the periphery of the side walls 12 and end walls 13 to strengthen and prevent distortion of the walls. A plurality of thin rectangular handles or tabs 17 are molded into the exterior surface of the longitudinal side walls 12 of the mold body 11 between the reinforcing ribs 16 and extend a very short distance horizontally outward from the top edge of the side walls. The tabs 17 aid in lifting the mold 10 evenly in an upward movement and are sufficiently short so as not to interfere with, or cause damage to, previously poured and immediately adjacent stones.

As best seen in FIGS. 1, 5, 6, and 7, an interior vertical wall 18 extends transversely across the interior of the mold body 11 near one end to partially separate the interior into a first generally rectangular cavity 19 and a second generally rectangular cavity 20 shorter in length than the first. The vertical wall 18 has a horizontal top portion 21 which divides the top wall 15 into two separate generally rectangular apertures or openings 22 and 23 at the top end of the cavities. The vertical wall 18 has an inverted U-shaped opening 24 which extends upwardly a distance from the bottom and terminates a distance beneath the horizontal top portion 21. The vertical wall 18 is approximately ¼ thick to form a gap between the adjacent stones. The inverted U-shaped open portion 24 of the vertical wall 18 allows the concrete to flow between the cavities 19 and 20 such that when poured, the lower portions of the adjacent stones will be joined beneath the gap by a short web of concrete, which can be removed if desired as described hereinafter.

Figure 7:
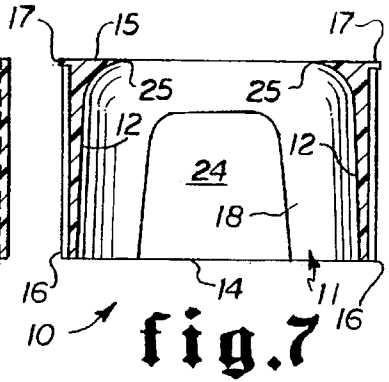
FIG. 7 is a transverse cross section of the mold device taken along line 7—7 of FIG. 2.
Figure 6:
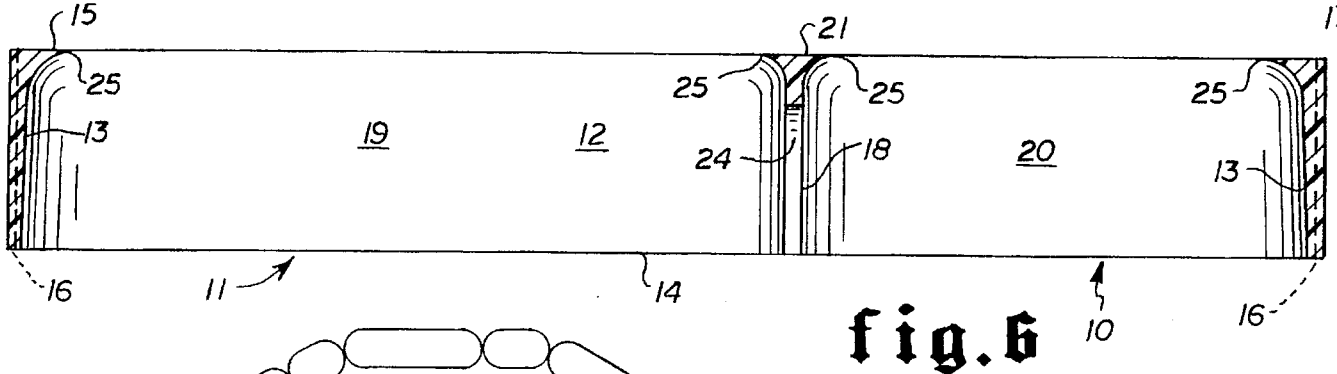
FIG. 6 is a longitudinal cross section of the mold device taken along line 6—6 of FIG. 2.

All the interior vertical surfaces of the walls are preferably tapered upwardly and inwardly at a small draft angle and are rounded at their juncture with the top wall 15 and the transverse vertical wall 18 to facilitate easy removal of the mold 10 from the freshly poured concrete and to form a smooth rounded exterior surface on the poured configuration. As best seen in FIGS. 6 and 7, the inward facing portion of the top wall 15 surrounding the openings 22 and 23 are reduced in thickness as they extend inwardly toward the center of the opening to form a very thin peripheral edge 25 surrounding the openings so as not to leave a deep ridge in the freshly poured concrete.

In the illustrated example, the openings 22 and 23 in the top wall 15 are irregular shaped generally rectangular configurations to impart a natural stone-like top upper portion on the poured configuration, however, it should be understood that various other shaped openings may be provided, such as oval, or rectangular with straight sides.

OPERATION

Use of the mold 10 to form a concrete border is relatively simple and a variety of border configurations are possible, such as straight lines, curves, and circles.

The mold may be placed directly on any relatively flat surface and it will automatically configure the concrete to the existing base. For professional results, removing the vegetation and loose soil from the area to be covered or removal of about one inch of top soil and leveling of the mold 10 before filling the cavities 19 and 20 with concrete is recommended. The removed soil may be used later to fill in spaces around the border after it has been completed.

It is recommended that one gallon of water be mixed with one 80-pound bag of pre-mix cement. The cement should be thoroughly mixed until a plastic-like consistency is reached. If additional water is required, one cup at a time should be added until the correct consistency is attained.

Each mold cavity 19 and 20 is filled with the cement mixture and is leveled with the upper surface of the top wall 15 of the mold 10. A trowel may be used to work in the cement and smooth the surface of the poured configurations.

The mold 10 may be removed as soon as the concrete holds its shape, and the outer surfaces and edges of the concrete stone shapes may be further smoothed with a trowel dipped in water until a satisfactory appearance is achieved.

When first poured, the cement flows through the inverted U-shaped open portion 24 of the vertical wall 18 such that there is a small gap between the adjacent stones except at their lower portions which are joined together by a short web of concrete filling the gap. If not separated, the adjacent stones will be joined together after the concrete cures. Optionally, the adjacent stones may be separated by cutting and removing the short web of concrete from the gap with a trowel.

Figure 8:
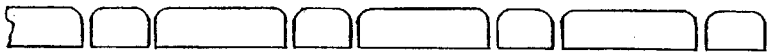
FIGS. 8, 9, and 10 are side elevations showing somewhat schematically various linear arrangements of adjacent concrete stones formed by the mold device.
Figure 9:
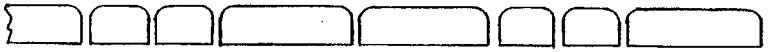
Figure 10:
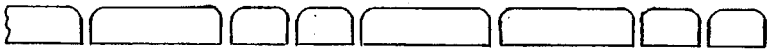

FIGS. 8, 9, and 10 are side elevations showing somewhat schematically various linear arrangements of adjacent concrete stones formed by the mold device. FIG. 8 shows a linear border using the adjacent longer and shorter stones which are joined together and placed in a row with the longer stones placed immediately adjacent the end of the smaller stones. FIGS. 9 and 10 shows linear borders using the adjacent longer and shorter stones which are joined together and placed in a row with the shorter stones placed immediately adjacent to one another and the ends of the larger stones placed immediately adjacent one another in alternating sequence.

Figure 11:
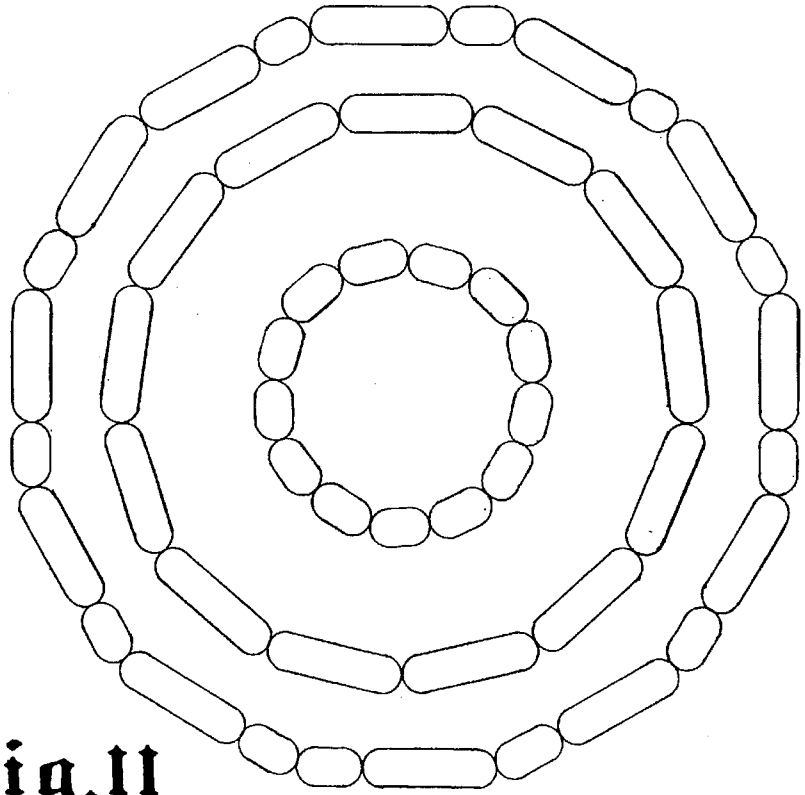
FIG. 11 is a top plan view showing somewhat schematically various circular border configurations using the concrete stones formed by the mold device.

FIG. 11 is a top plan view showing somewhat schematically various circular border configurations using the concrete stones formed by the mold device. Large curves and large diameter circles such as the outer circle may be formed using the adjacent longer and shorter stones which are joined together and placed in a row with the longer stones placed immediately adjacent the end of the smaller stones, or vice versa. The longer and shorter stones may be cut apart using a trowel so that they may be placed at an angle relative to one another to reduce the diameter of the circle or curve. A medium diameter circle may be formed by using only the longer stones which have been separated from the shorter ones, as shown in the intermediate circle. Small diameter circles may be formed by using only the shorter stones which have been separated from the longer ones, as shown in the center circle.

The discrete concrete segments may be left separated from and independent of one another with earth or other material used as a stabilizer, or the adjacent stones which are not connected may be joined together before they set up by pouring and working a small amount of cement into the gaps therebetween.

While this invention has been described fully and completely with special emphasis upon a preferred embodiment, it should be understood that within the scope of the appended claims the invention may be practiced otherwise than as specifically described herein.

I claim:

1. An apparatus for forming concrete border stones, comprising:

a unitary generally rectangular body having contiguous opposed longitudinal side walls, opposed outwardly curved end walls at each end thereof, an open bottom end, an apertured top wall, and an interior vertical wall extending transversely between said longitudinal side walls disposed closer to one of said opposed end walls than the other and of the same height as said side walls and said end walls, said contiguous walls joined together and concavely rounded at their juncture to form a smooth convex rounded exterior surface on the border stone configuration formed thereby;

said longitudinal side walls, end walls, and interior vertical wall circumscribing a longer generally rectangular cavity and a longitudinally adjacent shorter generally rectangular cavity;

generally rectangular openings in said top wall defining a longer generally rectangular curvilinear opening at an upper end of said longer cavity and a longitudinally adjacent shorter generally rectangular curvilinear opening at an upper end of said shorter cavity; and an opening through a lower portion of said transversely extending vertical wall, said opening adjoining a lower portion of adjacent ends of said longer generally rectangular cavity and said longitudinally adjacent shorter generally rectangular cavity together.

2. The apparatus according to claim 1 wherein said opening through a lower portion of said transversely extending vertical wall is an inverted generally U-shaped opening configured to allow flow of concrete between said adjacent cavities and form a concrete tab adjoining a lower portion of adjacent ends of longitudinally adjacent border stones formed by said apparatus.

3. The apparatus according to claim 1 wherein said top wall has a radially inward facing portion extending from its rounded juncture with said side walls, said end walls, and said transversely extending vertical wall, which is tapered and reduced in thickness in the inward facing direction to provide a thin inwardly facing edge surrounding each of said generally rectangular curvilinear openings for preventing the formation of a deep ridge in the exterior surface of the border stone configuration formed by said apparatus.

4. The apparatus according to claim 1 further comprising a plurality of integral vertical reinforcing ribs on the exterior surface of said unitary body spaced apart a sufficient distance to prevent distortion of said walls.

* * * * *